US005769445A

United States Patent [19]

Morrow

[11] Patent Number: 5,769,445

[45] Date of Patent: Jun. 23, 1998

[54] SNOWBOARD

[75] Inventor: Neil E. Morrow, Salem, Oreg.

[73] Assignee: Morrow Snowboards, Inc., Salem, Oreg.

[21] Appl. No.: 533,917

[22] Filed: Sep. 26, 1995

Related U.S. Application Data

[63] Continuation-in-part of Ser. No. 221,857, Apr. 1, 1994, abandoned.

[51] Int. Cl.[6] ..... A63C 5/14

[52] U.S. Cl. ..... 280/610; 280/14.2

[58] Field of Search ..... 280/610, 14.2, 280/601, 602, 608, 609; 428/102, 105, 107, 111–113, 231

[56] References Cited

U.S. PATENT DOCUMENTS

| | | | |
|---|---|---|---|
| 4,035,000 | 7/1977 | Lacroix | 280/610 |
| 4,412,687 | 11/1983 | Andre | 280/610 |
| 4,690,850 | 9/1987 | Fezio | 280/610 |
| 4,767,369 | 8/1988 | Snyder | 280/610 |
| 4,897,063 | 1/1990 | Scheurere | 280/610 |
| 4,902,548 | 2/1990 | Cholat-Serpoud | 428/102 |
| 5,169,170 | 12/1992 | Hayashi | 280/610 |
| 5,238,260 | 8/1993 | Scherubl | 280/610 |
| 5,320,378 | 6/1994 | Wiig | 280/14.2 |
| 5,496,053 | 3/1996 | Abondance | 280/609 |
| 5,591,509 | 1/1997 | Lorenz | 280/610 |
| 5,599,036 | 2/1997 | Abondance | 280/602 |

FOREIGN PATENT DOCUMENTS

| | | | |
|---|---|---|---|
| 0232484 | 8/1987 | European Pat. Off. | 280/610 |
| 1463013 | 11/1966 | France | 280/610 |
| 2250546 | 7/1975 | France | 280/610 |
| 0413683 | 12/1966 | Switzerland | 280/610 |

OTHER PUBLICATIONS

*Engineered Materials Handbook,* vol. 1, ASM International, chapters entitled "Introduction to Composites", pp. 27–29, 32–33 and 50–51; Epoxy Resins, pp. 66–71; Polymide Resins, pp. 78–79.

*Primary Examiner*—Anne Marie Boehler
*Attorney, Agent, or Firm*—Dellett and Walters

[57] ABSTRACT

A composite torsion box core for a snowboard comprises a center core member of lightweight wood or foam enveloped within a composite of a seamless, large diameter tubular sock. By expanding or compressing the length of the large diameter tubular sock during fabrication, the alignment of fibers within the sock is adjusted for programming a desired longitudinal and torsional rigidity relationship for the snowboard. Furthermore, side members, comprising separate composite torsion box cores having smaller diameter tubular socks, are disposed on opposite sides of the center core member and provide increased side strength for the overall torsion box core for enhancing the snowboard's edging strength without compromising torsional flexibility. Plural side members of various materials, sizes and spacing relative to each other are employed to provide snowboards having differing ride characteristics.

8 Claims, 5 Drawing Sheets

SNOWBOARD

This application is a continuation-in-part of application Ser. No. 08/221,857, filed on Apr. 1, 1994, now abandoned.

BACKGROUND OF THE INVENTION

The present invention relates to a snowboard and more particularly to a snowboard having an improved core and method of manufacturing the same.

The sport of snowboarding is an increasingly popular wintertime activity wherein a snowboarding enthusiast (hereinafter "snowboarder") maneuvers the board down a snow-covered slope while standing thereon. The board is provided with upturned nose and tail sections of greater flexibility which assist in traveling over the surface of the snow.

While riding the snowboard, the snowboarder manipulates the board to perform various maneuvers. Such manipulations include rocking the board about the longitudinal axis for edging, advancing either the tail or nose section relative the longitudinal axis for initiating a turn, and lifting one or both of the nose and tail sections for performing more advanced maneuvers. To facilitate board manipulation, the snowboarder desires that the board be lightweight, strong and resilient.

It is known to wrap fiberglass, fiber reinforced composite, around a base core to provide a strong and lightweight torsion box construction for a snowboard. A sheet of woven glass (reinforcement) fiber is wetted with a binder resin and wrapped around the base core with a slight overlap, the base core being made of a lightweight wood or a synthetic foam such as polyurethane. The wetted reinforcement fiber sheet is then cured about the base core within a press, wherein heat may be applied for accelerating the curing process. During curing, the press molds the wetted fibers and base core with a desired profile while squeezing out excess resin so that the resulting cured composite is adhered to the base core without air pockets.

A snowboarder desires various degrees of longitudinal and torsional rigidity depending upon the snowboarding conditions and style. Longitudinal rigidity characterizes the board's ability to bend along its length. Torsional rigidity describes the ability of the board to flex and twist about its longitudinal axis. For downhill speed, a stiff snowboard is generally preferred wherein the longitudinal and torsional flexibilities are limited. In contrast, a soft snowboard having increased longitudinal and torsional flexibility is desirable for performing tricks and maneuvering amongst moguls and bumps. However, torsion box cores thus far have had limited degrees of freedom between longitudinal rigidity and torsional rigidity.

Another snowboard parameter is edging strength, which determines the ability of the board to cut and hold an edge against a slope under forces of a turn or stop. Edging strength is primarily related to the strength of the vertical composite side walls of the torsion box construction formed around the base core. In addition, while carving such a turn or stop, it is common to encounter an object with the edge of the snowboard, which object imparts a localized force to the vertical composite side wall of the torsion box core proximate the point of impact. If great enough, the localized force, which is not uniformly distributed across the snowboard, can cause a fracture in the vertical composite side wall or cause a portion of the board to break away proximate the localized force. Therefore, a strong composite is desired for providing the torsion box core with strong vertical composite side walls. However, the snowboard's edging strength and rigidity are both related to the strength of the composite of the torsion box core such that increasing the strength of the composite of the torsion box core for improving the board's edging strength in turn decreases the board's flexibility.

Another concern is a strength/weight compromise. As stated, board thickness can be increased for enhancing board stiffness proximate the mid-section relative the nose and tail sections. However, increased core thickness adds to the weight of the snowboard.

It is accordingly an object of the present invention to provide an improved core for a snowboard.

It is a further object of the present invention to provide an improved core for a snowboard with strong sides.

It is yet another object of the present invention to provide a core construction permitting a greater degree of freedom between its longitudinal and torsional flexibilities.

It is another object of the present invention to provide an improved core for a snowboard of enhanced stiffness that does not compromise weight.

SUMMARY OF THE INVENTION

In accordance with the present invention in a particular embodiment thereof, a method of manufacture provides a core of given longitudinal and torsional flexibility for a snowboard. An elongate center core member is disposed between two side rods. The center core member and the adjacent side rods are enveloped within a strengthening composite. The composite and the two side rods establish primarily the longitudinal flexibility and edge strength for the snowboard whereas the composite and center core member establish the torsional flexibility for the snowboard while contributing secondarily to the longitudinal flexibility.

In accordance with an embodiment of the present invention, a method of manufacturing a core for a snowboard provides an elongate core member, which is wide enough for standing on, inserted into a seamless tubular fiber sock. The fiber sock is wetted with a binder resin so as to provide a composite about the circumference of the elongate board member.

In accordance with another aspect of the present invention, a snowboard comprises a torsion box core having an elongate core member, wide enough for standing on, enveloped within a seamless composite.

In accordance with a further embodiment of the present invention, an elongate center core member is disposed between two side rods which extend along a mid-length, on respective opposite sides, across a width thereof. The elongate center core member and two side rods are enveloped within a composite.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
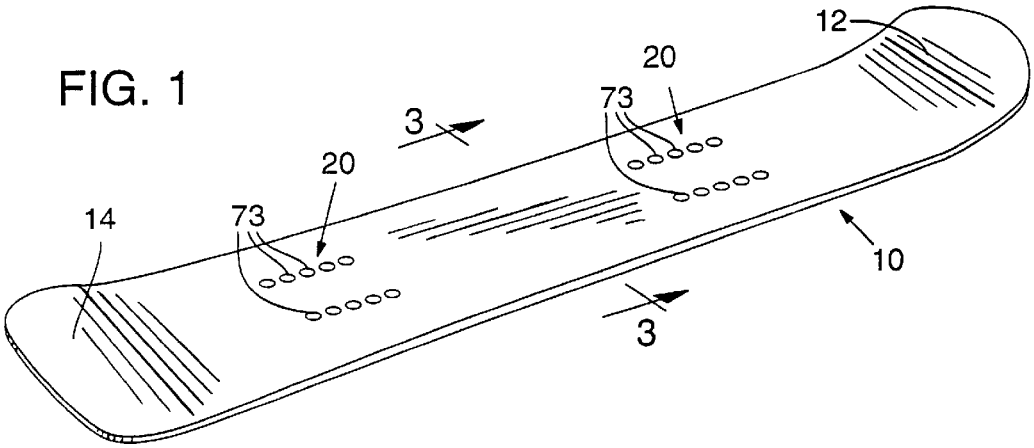
FIG. 1 is a perspective view of a snowboard with upturned nose and tail sections and mounting holes on its upper surface.
Figure 2:
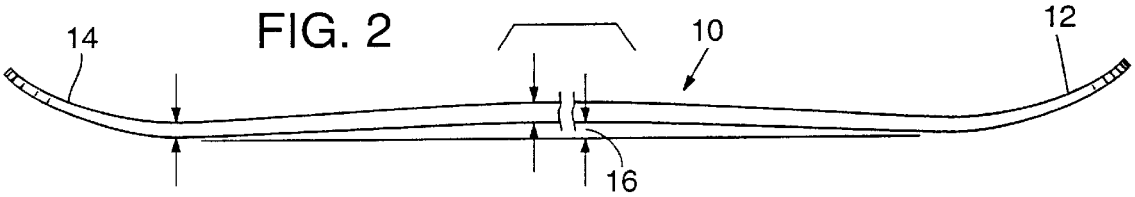
FIG. 2 is a side profile illustrating the snowboard's camber and thickness along its length.

With reference to FIG. 1, snowboard 10 comprises an elongate board having upturned nose 12 and tail 14 sections of greater flexibility for assisting the board in traveling over the surface of snow. The width of the snowboard varies along its length. At its waist, the snowboard has a width of seven to eight inches which is sufficient for seating the boots of a snowboarder, while proximate the nose and tail sections, the width of the snowboard is anywhere from 10 to 13 inches. The thickness of the snowboard, with reference to FIG. 2, also varies along its length. Near the middle of the snowboard, the thickness is typically about ⅜ to ½ inch thick, depending upon the type of base core used and the stiffness desired, while near the nose 12 and tail 14 sections, where greater flexibility is desired, the thickness tapers down to about ¼ inch. The length of the snowboard is anywhere from 125 centimeters (51 inches) to 200 centimeters (75 inches) depending upon the size of the snowboarder and style of snowboarding desired. The board also has a camber 16 along its mid-length for assisting board resilience.

Mounting holes 20 are provided on top of snowboard 10 so that left and right bindings may be mounted for receiving boots of the snowboarder. The respective left and right mounting hole patterns are spaced apart along the mid-length of the board so that when a snowboarder stands in respective mounted bindings, the snowboarder's feet are spaced beyond shoulder width and the snowboarder's toes are pointed in a direction primarily perpendicular to the longitudinal axis of the board.

Figure 4:
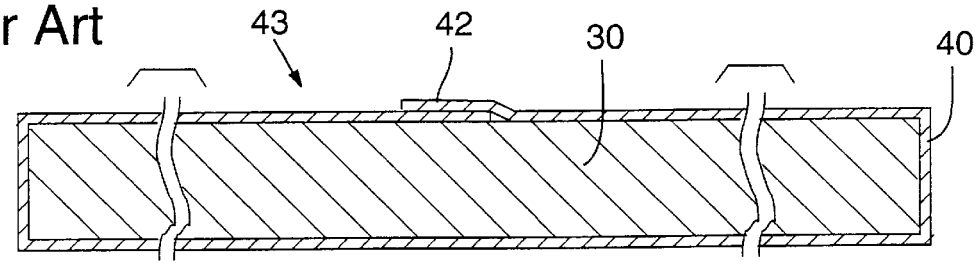
FIG. 4 Prior Art
FIG. 4 is a cross section illustrating a prior art composite torsion box core.
Figure 5:
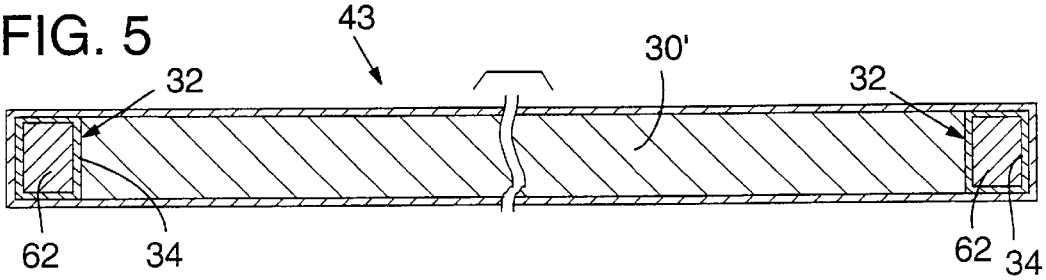
FIG. 5 is a cross section of a core in accordance with the present invention.

To obtain a strong yet lightweight snowboard, base core 30 in FIG. 4, of lightweight wood or foam, is wrapped with composite 40 so as to provide a composite torsion box core 43. Prior art torsion box cores, with reference to FIG. 4, are prepared by first precutting a reinforcement fiber sheet into a predetermined shape having a length substantially equal to the length of the board and a width sufficient for wrapping around the circumference of the base core with a slight overlap. Base core 30 and the precut reinforcement fiber sheet are wetted with epoxy resin whereupon the wetted reinforcement fiber sheet is then wrapped around the wetted base core 30 leaving an overlap seam 42 which extends the length of the board. The prior art composite wrap 40 does not provide a continuous fiber structure about the circumference of the base core and contributes extra weight due to the composite overlap.

A composite is a combination of two or more materials which materials, when combined, augment one another to provide structural properties. A composite according to the present invention includes reinforcement fibers and a matrix binder. The reinforcement fibers provide the composite with its primary tensile strength, whereas the matrix binder serves to molecularly intercouple the reinforcement fibers within its own polymerized, cross-linking structure. The fibers of the present invention include glass fibers of E glass or S glass, carbon fibers, or hybrid combinations of glass and carbon fibers.

The reinforcement fibers are supplied in either a woven sheet or a unidirectional sheet configuration. In the unidirectional sheet configuration, continuous fibers run alongside one another, in parallel, and are loosely coupled together with occasional sewn threads or glue lines which keep the fibers intact and assist sheet handling capabilities. In the woven sheet configuration, continuous fibers are interwoven with little need for sewn threads or glue lines for maintaining sheet integrity. The reinforcement fibers are all of one type or, alternatively, a hybrid combination of carbon and glass fibers.

In an alternative form, a pair of unidirectional sheets overlie one another with an angular relationship between the respective fibers. For example, in a 0°–90° relationship, one of the unidirectional fiber sheets has its fibers extending parallel, i.e., with a 0° angular relationship to a given longitudinal axis, while the other overlying unidirectional fiber sheet has its fibers oriented perpendicularly, i.e., in 90° angular relationship with the longitudinal axis. The two unidirectional sheets are sewn together along an outside perimeter so that they may be handled together as a single sheet.

The cross-linking molecular structure of the matrix binder binds the reinforcement fibers together within a hardened composite structure and reinforces the fibers with proper alignment for withstanding compressive and expansive forces. In the preferred embodiment of the present invention, the matrix binder is an epoxy resin mixture of DER330 and DER331 as supplied by Dow Chemical Inc., in a 50—50 ratio, and the curing agent comprises a hardener 1769 obtained from Pacific Ancor, Portland, Oreg. The epoxy and curing agent are combined together for effecting the polymerization. To make a composite, the resin and hardener mixture, after being combined but before polymerization, is used for wetting a reinforcement fiber sheet, after which the epoxy resin of the impregnated reinforcement fiber sheet hardens the composite.

As described hereinbefore, prior art torsion box cores, with reference to FIG. 4, are not provided as a continuous structure around the circumference thereof, but rather are left with an overlapping composite seam 42. Thus, the bonding strength of the matrix binder and the width of the seam overlap must be great enough for withstanding shear forces which may result between the upper and the lower layers of the overlapping composite seam 42.

Figure 3:
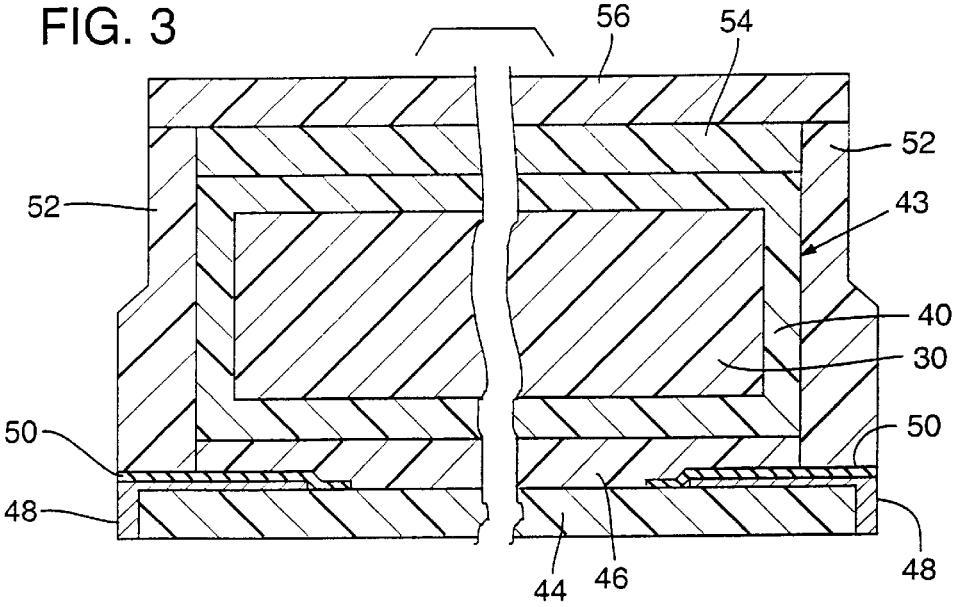
FIG. 3 is a cross section of the FIG. 1 snowboard taken across the width of a torsion box core at its midsection.

In accordance with the present invention, with reference to the cross section of FIG. 3, a seamless composite 40 takes the form of a wide diameter continuous tube or sock of interwoven continuous reinforcement fibers. Wide diameter socks which are suitable can be obtained from Atkins and Pierce of Covington, Ky. The reinforcement fibers of the tubular sock wrap around the core and thus eliminate the overlapping seam and accordingly provide the torsion box core 43 with enhanced strength and reduced weight.

According to another aspect of the present invention, interwoven fibers of a tubular sock can be arranged for providing the snowboard with a desired degree of torsional rigidity with respect to its longitudinal rigidity. As supplied, the tubular sock has an initial diameter wherein the interwoven fibers of the woven pattern have a perpendicular relationship with respect to one another and a 45° angular relationship with respect to the longitudinal axis of the sock. However, by compressing the tubular sock, the diameter of the sock increases and the interwoven fibers shift to provide an angular relationship with respect to longitudinal axis greater than 45°. In contrast, if the tubular sock is stretched, the sock diameter decreases and the fibers realign themselves more toward the longitudinal axis. A compressed tubular sock provides a composite torsion box core with enhanced torsional rigidity with respect to longitudinal rigidity, whereas an elongated tubular sock provides a composite torsion box core with enhanced longitudinal rigidity. Thus, a diameter of the tubular sock can be selected for providing a composite torsion box core of a desired torsional rigidity relative its longitudinal rigidity.

In decreasing order, an eight-inch diameter sock, when pulled over a typical core, provides about a 33° angular relationship between the sock's fibers and the longitudinal axis of the core, forming a torsion box core of enhanced longitudinal rigidity. A seven-inch diameter sock provides approximately a 43° angular relationship between the fibers and the longitudinal axis for obtaining a torsion box core of intermediate torsional and longitudinal rigidity. Finally, a six-inch diameter sock, once compressed for increasing its diameter, to receive the core, provides about a 57° angular relationship of its fibers with respect to the longitudinal axis for forming a torsion box core of enhanced torsional rigidity. Generally, a torsionally rigid board is desired for snowboarding down a tight run, such as a chute, and for holding an edge when carving high-speed turns. On the other hand, a less torsionally rigid board, which is more forgiving of landing errors, is typically desired for free-style snowboarding. In between the two performance levels is the all-around recreational snowboard of average flexibility.

Base core 30 functions primarily as a lightweight structure for supporting the tubular sock with a desired shape until epoxy resin wetted fibers are cured within a curing press. Base core 30 has a thickness profile and outline shape corresponding to the profile and outline shape desired for the snowboard. In one aspect of the present invention, base core 30 is molded, low-density polyurethane foam. In another embodiment of the present invention, base core 30 comprises vertically laminated wood, made up of long pieces of wood vertically laminated together side-by-side.

With reference to FIG. 3, additional elements of the snowboard include top 54 and bottom 46 comprising unidirectional fiberglass sheets which sandwich torsion box core 43 therebetween, and top 56 and bottom 44 plastic layers which overlie the respective top and bottom unidirectional fiberglass sheets. Bottom plastic layer 44 comprises a high-density plastic such as polyethylene (PTEX) which provides a smooth, snow-repellent bottom for assisting the snowboard in traveling rapidly over snow. According to one aspect of the present invention, the snowboard bottom is convex so that when the snowboard is on a flat surface, metal edges 48, at the bottom side edges of the snowboard, do not contact the snow unless the snowboard is rocked to one side or the other. Metal edges 48 have greater friction against snow than the high-density plastic of layer 44 and are kept from contacting the snow by the convex bottom until needed for carving a turn or stopping.

Metal edges 48 each have an L-shaped cross-sectional configuration which resides along the outside perimeter of the bottom plastic layer 44 with the longer portion of the cross-sectional L-shape sandwiched between unidirectional fiberglass sheet 46 and plastic layer 44 and the shorter portion of the cross-sectional L-shape pointed down along the sides of the plastic layer 44. Because of a difference between the thermal expansion coefficients of the metal edges and the unidirectional fiberglass sheet, thin rubber sheets 50 are supplied between the two so as to provide a thermal expansion interface for buffering shear forces.

The width of the bottom plastic layer 44 extends, so as to form subshelves, on opposite sides beyond and beneath the width of torsion box core 43 and unidirectional fiberglass sheet 46. Plastic side walls 52 stand upon the respective subshelves and box in the width of torsion box core 43 and unidirectional fiberglass sheet 46. Laminated to the top of torsion box core 43, between side walls 52, is a top unidirectional fiberglass sheet 54. Top plastic layer 56 is laminated over fiberglass sheet 54 and the two side walls 52.

The top 54 and bottom 46 unidirectional fiberglass sheets have their glass fibers running primarily parallel to the longitudinal axis of the snowboard and enhance its longitudinal rigidity. Alternatively, the top and bottom fiberglass sheets may be each overlaid with an additional secondary overlapping unidirectional glass reinforcement sheet having secondary fibers running perpendicular to the longitudinal axis of the snowboard for improving its torsional rigidity. In a particular embodiment of the present invention, such a two-layered structure had an 80:20 relative density ratio between respective longitudinal and perpendicular fibers.

The torsion box core 43 is operative to provide a snowboard its structural strength. The vertical side walls of the torsion box core (adjacent plastic side walls 52) support edging forces of the snowboard when carving turns and thus determine the snowboard's edging strength. The top ceiling and bottom floor of the torsion box core 43 affect primarily the longitudinal and torsional rigidity of the snowboard as described hereinbefore regarding the orientation of reinforcement fibers.

The plastic side walls 52 protect the reinforcement fibers of the vertical composite side walls of torsion box core 43 from abrasions resulting from side impacts of the snowboard with sticks, rocks and debris. The plastic side walls therefore act as bumpers for preventing the vertical composite side walls from being damaged or fractured from such side impacts to the snowboard. As described hereinbefore, bottom plastic layer 44 of polyethylene provides primarily a fast snow-repellent surface for the snowboard. In contrast, the top plastic layer 56 serves primarily to protect the top fiberglass sheet 54 and composite of the torsion box core 43 from structural damage by buffering impacts. Top plastic layer 56 may also include a graphic design on its upper surface for esthetic purposes. Also, the plastic walls 52 in combination with the plastic top and bottom layers 56 and 44 provide a seal for preventing moisture from penetrating the composite core.

As indicated, by using a large diameter tubular sock for torsion box core 43, the overlapping composite seam is eliminated for providing greater strength and reduced weight for a snowboard employing such a torsion box core. Furthermore, by stretching or compressing the tubular sock, the reinforcement fibers of the tubular sock are rearranged for programming the snowboard's torsional rigidity and longitudinal rigidity.

Figure 7A:
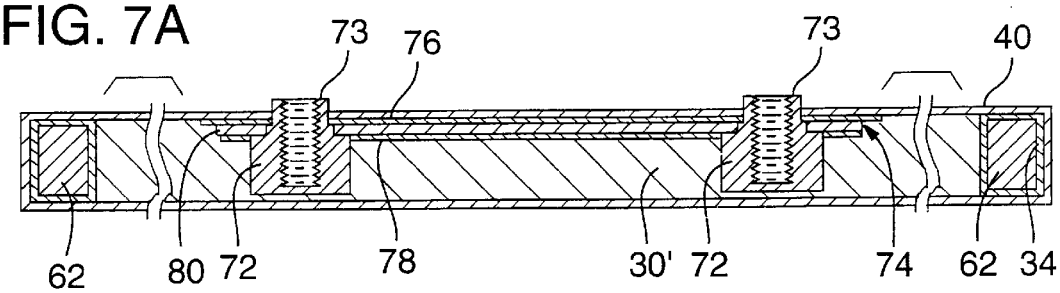
FIG. 7A is a cross-section of the FIG. 6 core in accordance with an embodiment of the present invention.
Figure 7B:
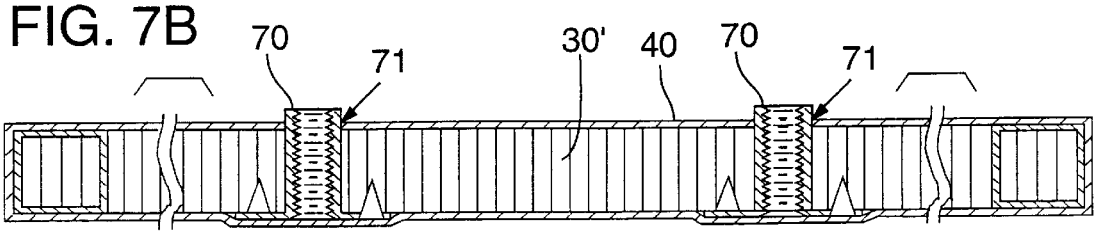
FIG. 7B is a cross-section of the FIG. 6 core illustrating an alternative embodiment of the present invention.

In accordance with a particular embodiment of the present invention, with reference to FIGS. 5, 6, 7A and 7B, a center core member 30' is disposed between two side rods 32 and enclosed, together with the adjacent side rods, within composite 40 of a large diameter, reinforcement fiber tubular sock. Center core member 30' has an outline corresponding primarily to the shape of the snowboard desired but with the exception of side cut-outs 64 along opposite sides and across the width of a mid-section thereof. According to one aspect of this embodiment, wherein the center core member is molded polyurethane foam, the side cut-outs are provided by stamping an original size foam core (of an outline corresponding to the desired snowboard) with a die press so as to cut away the cut-out portions. Preferably, the cut-out portions are then used as inner core members 62 of respective side rods 32. In contrast, when the core construction is formed of vertically laminated wood as shown in FIG. 7B, the side cut-outs are milled from an original wooden core member (of an outline corresponding to the desired snowboard outline) and separate inner core members 62 are obtained for the side rods 32. The length of the side rods 32 match the length of the side cut-outs 64. In the preferred embodiment of the present invention, side rods 32 have a length which extends the length of an effective edge of the snowboard between the upturned nose and tail sections and have a width of about one inch.

The two side rods 32 suitably comprise the same material as the center core member 30'. However, the two side rods may employ materials which differ from those of the center core member in accordance with desired rigidity objectives.

Preferably, each of the two side rods comprises a separate torsion box construction 34, wherein a small diameter tubular sock is wetted with an epoxy resin and cured about an inner core member 62 which is closely received within the sock. Each of the small diameter tubular socks of the respective side rods comprises reinforcement fibers of glass, carbon, or a hybrid of both glass and carbon, e.g. the same materials as sock 40. Preferably, the reinforcement fibers of the small diameter socks are the hybrid of both glass and carbon fibers interwoven in substantially equal amounts.

During manufacture, the separate core members 62 of the side rods are wetted with the matrix binding resin in the same manner as hereinbefore described along with the respective small diameter tubular socks. The wetted inner core members are inserted into the respective wetted small diameter socks and placed adjacent the center core member 30', which also has been wetted along with a large diameter reinforcement fiber tubular sock 40 with the binding resin. Next, the center core member 30' and adjacent side rods 32 are inserted into wetted large diameter tubular sock 40, whereupon the large diameter tubular sock 40 is pulled so that the diameter of the sock contracts and conforms to the shape of the center core member 30' with the rods 32 on either side. After the large diameter sock is pulled tightly, the ends of the large sock are cut in accordance with the outline of the snowboard at the respective nose and tail sections.

The side rods 32 enhance torsion box core 43 by adding additional vertical composite walls proximate the sides of the core. Instead of there being just one vertical composite side wall of composite 40 at each side of the torsion box core 43, the small diameter tubular sock of each rod 32 adds additional vertical side walls which augment the single vertical composite side wall of the large tubular sock of composite 40. Thus, a total of three vertical composite side walls strengthen each side of the torsion box core 43. The additional vertical composite side walls, as provided by rods 32, provide the snowboard 10 with improved edging strength and longitudinal rigidity. However, because rods 32 are provided at the sides of the board only, the torsional flexibility of the board is not compromised. Therefore, the three-core embodiment (with side rods 32) provides enhanced edging and longitudinal rigidity for the snowboard independent of torsional rigidity. The edging strength and longitudinal rigidity of the core 43 and board 10 are further improved by employing a stronger composite, e.g. comprising mainly or entirely carbon reinforcement fibers, for side rods 32. Again, as in the case of the previous embodiment, the large diameter tubular sock for the outer composite 40 of torsion box core 43 eliminates the overlapping seam for providing greater strength with reduced weight and may be compressed or stretched for programming a desired torsional rigidity for snowboard 10.

Figure 6:
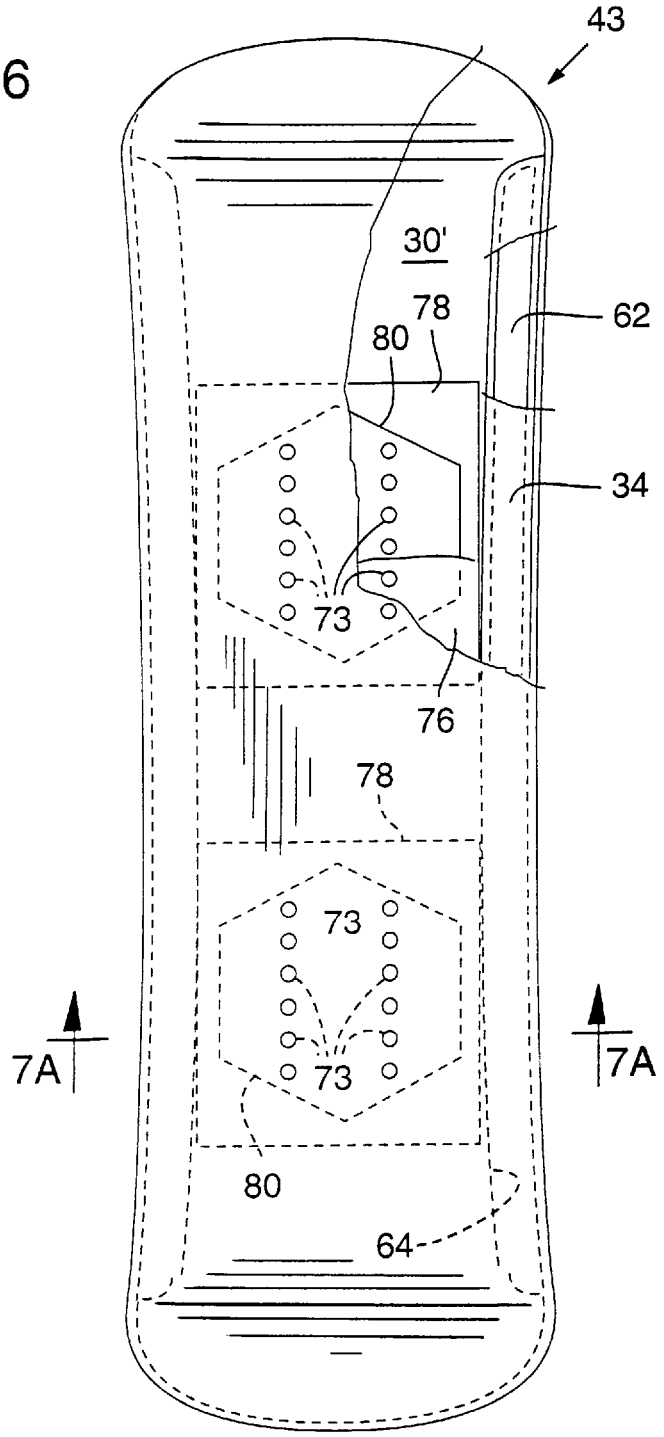
FIG. 6 is a top view of a core of a board according to the present invention.

As described hereinbefore with reference to FIG. 1 and FIG. 6, mounting holes 20 on the top of the snowboard are provided so that a pair of bindings may be attached to the snowboard for securing boots to the board. When center core member 30' (or core member 30 of the previously described embodiment) is vertically laminated wood as in FIG. 7B, then mounting holes 20 comprise T-nuts 70 inserted into bores 71 of the wooden center core member 30'. Bores 71 pass through the thickness of the core and are provided in accordance with the hole pattern 20 desired for mounting bindings. Each T-nut 70 is an internally threaded tube having a flat collar extending radially from a tail end thereof. The flat collar includes pointed prongs which point up from the flat collar alongside the internally threaded tube. T-nuts 70 are inserted into bores 71 from the bottom side of the wooden core so that the pointed prongs of the T-nuts project into the core just outside the perimeter of the respective bores. Once fully inserted, the upper surface of the flat collar of each T-nut is flush against the bottom surface of the core. The prongs of the T-nuts prevent the T-nuts from twisting upon receiving bolts subsequently when a binding is being mounted thereto. The flat collars work against core 30' so as to retain a subsequently mounted binding to the snowboard when the binding receives a lifting force with respect to the snowboard. Thus, the T-nuts, with collars and prongs, help secure a binding to the snowboard particularly when the center core member is vertically laminated wood.

When center core member 30' comprises molded polyurethane foam, an alternative mounting hole assembly is employed. With reference to FIGS. 6 and 7A, molded polyurethane foam center core member 30' has two separate surface recesses 74 seating two flat aluminum plates 80 that assist mounting of respective left and right bindings. Each aluminum plate 80 has a pattern of holes corresponding to the desired mounting hole pattern 20. The area of each aluminum plate 80 matches the area of the respective surface recess 74 within the top surface of the foam core 30' and encompasses the perimeter of the associated mounting hole pattern 20. Each hole of the aluminum plate secures an end nut 73 that is an internally threaded tube having a radially extending flange at one end of a hexagonal shaped head extending beyond the outside diameter of the tube. The outside circumference of the internally threaded tube proximate the abutting flange is ribbed to provide a friction fit with the end nut inserted into a hole of the aluminum plate.

Thin rubber sheets 76 and 78 respectively are employed above and below the aluminum plate. Bottom rubber sheet 78 provides a thermal expansion interface between aluminum plate 80 and the epoxy treated, i.e., wetted and cured, polyurethane foam center core member 30'. The top rubber sheet 76 supplies a thermal expansion interface between aluminum plate 80 and the composite formed by the epoxy treated large diameter sock 40. Inset holes 72 are located in the bottom floor of each surface recess 74 and receive the hexagonal shaped heads of the end nuts 73 which protrude from the bottom of the associated aluminum plate 80; thus, aluminum plate 80 sits in surface recess 74 with its bottom face meeting rubber sheet 78 which lines the floor of the surface recess. Rubber sheet 78 has a pattern of clearance holes corresponding to mounting hole pattern 20 so that the hexagonal shaped heads of the end nuts 73, protruding from the bottom of the aluminum plate, can pass through rubber sheet 78 and into the inset holes 72. The top rubber sheet 76 overlies aluminum plate 80 with an area that extends beyond the aluminum plate and onto the foam core 30'. Top rubber sheet 78 also includes clearance holes corresponding to the mounting hole pattern 20 for permitting access to the mounting holes 20.

The hexagonal shaped heads of the end nuts 73, as seated in the inset holes, are secured therein with cured epoxy filling any space between the sides of the hexagonal shaped heads and the inside cylindrical walls of the respective inset holes. Thus, the hexagonal shaped heads working against the cured epoxy within the inset holes in combination with the friction fitting ribs of the end nuts 73 working against the aluminum plate serve to prevent the end nuts 73 from twisting when receiving bolts for mounting a binding. The upper surface of the flange provided by the hexagonal shaped heads of the end nuts 73 working against the bottom surface of aluminum plate 80, in combination with the aluminum plate working against top rubber sheet 76 and composite 40, serve to retain a mounted binding to the snowboard when the binding receives a lifting force with respect to the snowboard.

The large diameter tubular sock 40 and top unidirectional fiberglass sheet 54 each have clearance holes corresponding to the mounting hole pattern 20 for clearing the respective holes of mounting hole pattern 20. Once the torsion box assembly, with mounting hole provisions and side rods, has been completed, it is incorporated with the remaining snowboard elements, as shown and described previously with reference to FIG. 3, and then placed in a heated press for curing. To assist bonding between the various elements, foam core 30', rubber sheets 76 and 78, and aluminum plate 80 each have their surfaces scuffed to assist epoxy penetration or adhesion thereto.

Figure 8:
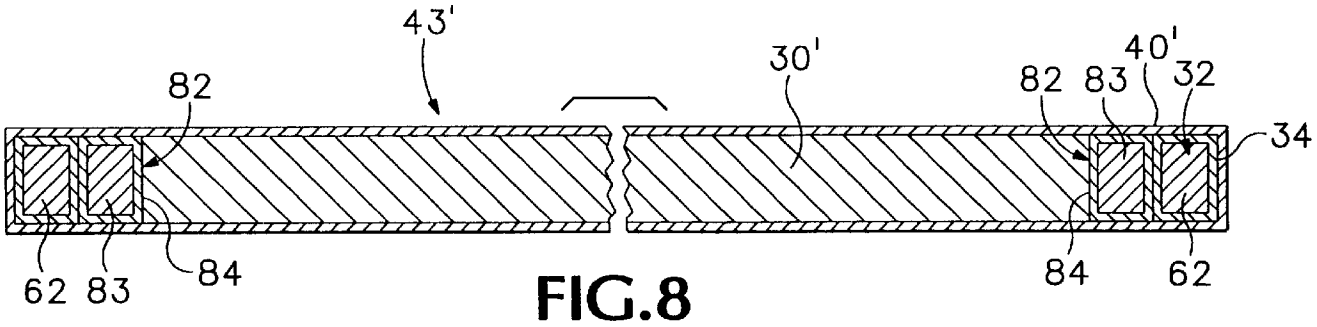
FIG. 8 is a cross-section view of a snowboard core in accordance with a double side rod embodiment.

Referring now to FIG. 8, which is a cross-section view of a snowboard employing two side members, in accordance with the present invention, as in embodiments described hereinabove, the snowboard includes a base core 30' wrapped with a composite 40' which is suitably seamless to provide a composite torsion box core 43'. In this embodiment, a first side member 32 is employed similar to the embodiment of FIG. 5, for example, to generate a separate torsion box 34 contained within torsion box 43' at a longitudinal edge thereof. In this embodiment, an additional side member 82 which is enclosed within a seamless sock provides a second torsion box 84 which is positioned between the first torsion box 34 and central core 30' of the snowboard. Core member 83 is employed in construction of the second side member 82, wherein the core member suitably comprises similar material to that of core member 62. Alternatively, as discussed hereinbelow, the second side member may be of different material or dimensions. A suitably mirror image construction is employed on the opposite side of the board. In accordance with this embodiment of the invention, the plural side member/torsion box construction provides different structural dynamics to the board as compared with a standard board employing either no torsion members at the sides thereof or the embodiment employing a single torsion member. In the embodiment of FIG. 8, the side member cores 62 and 82 are suitably constructed of the same material and are of similar dimensions. This material may or may not be the same as central core 30'. However, to obtain different functional response, the dimension and material of the side members may be varied as desired.

Figure 9:
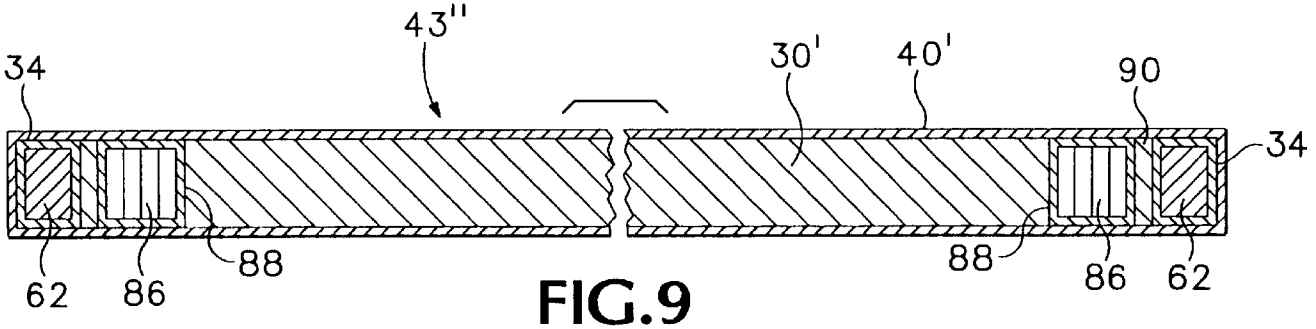
FIG. 9 is a cross-section view of an alternative double side rod embodiment snowboard.

Referring to FIG. 9, an embodiment is shown employing an inner side member 86 which carries its own composite sock in surrounding relation to generate torsion box 88, wherein the side member 86 is spaced somewhat apart from the outer side member 62, leaving spacer portion 90 separating the two torsion boxes 34 and 88. The ride characteristics of this board 43" are thus suitably altered somewhat relative to the characteristics of the board of FIG. 8 due to the structural stiffness changes relative between the different boards.

Figure 10:
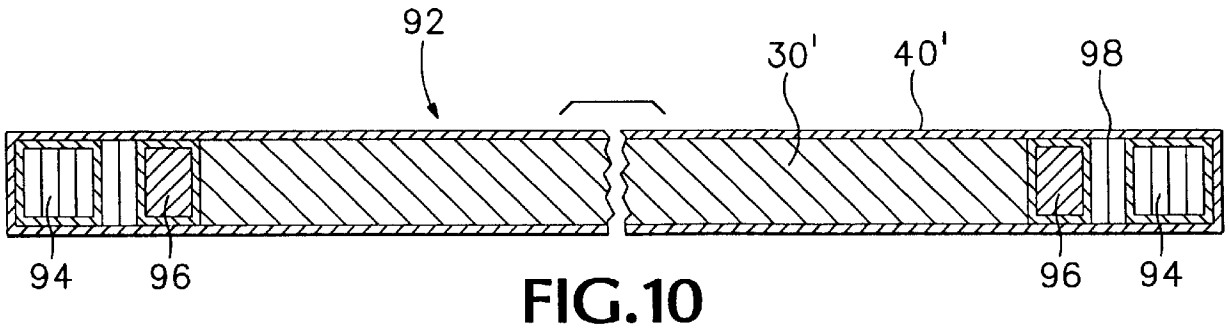
FIG. 10 is cross section view of a snowboard in accordance with yet another multiple side rod embodiment.

Referring to FIG. 10, an alternative snowboard embodiment 92 employs an outer side member 94 which is wider and comprises different material than inner member 96. A spacer region 98 is provided between the two members 94 and 96, wherein in the illustrated embodiment, spacer 98 is of a different material than the material of central board core 30'. Spacer 98 may suitably be a denser foam, more or less flexible, or of other structural characteristics as desired.

Figure 11:
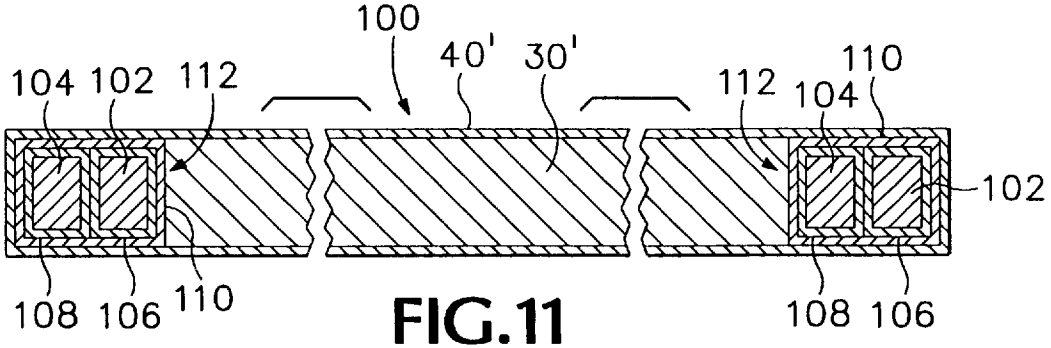
FIG. 11 is still further embodiment cross-section view of a snowboard employing multiple side rods.

The embodiment of FIG. 11 is a snowboard 100, wherein two adjacent side members 102, 104 are employed, each member having its own torsion box construction via the use of respective composites 106 and 108. However, the two torsion boxes formed of members 102 and 104 are further contained within and comprise a third torsion box 112, wherein composite 110 surrounds the two side members 102 and 104 and their individual composite envelopes.

Figure 12:
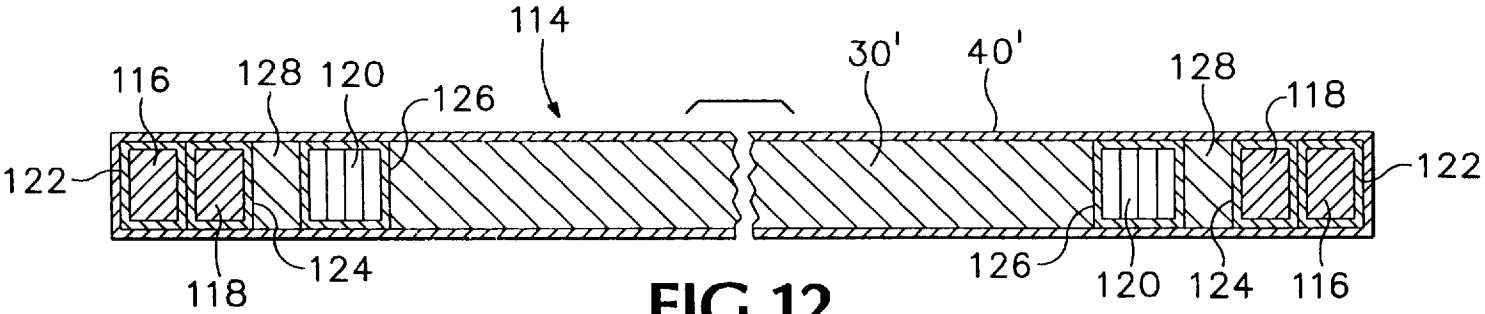
FIG. 12 is a cross-section view of a snowboard employing still more side rod members.

Referring now to FIG. 12, a snowboard 114 employs at least three side members 116, 118 and 120, with the side members being enveloped within their respective composite socks 122, 124 and 126. In the illustrated embodiment, side members 116 and 118 are in abutting relation at the outer edge of the snowboard. A spacer 128 separates member 118 and member 120, with side member 120 being positioned nearer the longitudinal centerline of the snowboard than member 118. Still additional side members may be employed in addition to the three illustrated, if desired.

The multiple side member construction need not be employed across substantially the entire length of the snowboard. Rather, regions of the board may employ two or more side members, while other regions of the snowboard may be desirably of less stiffness and accordingly may employ only one side member or be entirely free of side members along a portion thereof.

While various embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A snowboard comprising:

an elongate core member;

a first left side torsion box member and a first right side torsion box member, said first side members positioned adjacent at least respective first portions of left and right longitudinal edges of said elongate core member; and a second left side torsion box member and a second right side torsion box member positioned adjacent longitudinal edges of said first left and right side torsion box members respectively, wherein said first torsion box members, said second torsion box members and said elongate core member are contained within a third torsion box.

2. A snowboard comprising:

an elongate core member;

a first left side torsion box member and a first right side torsion box member, said first side members positioned adjacent at least respective first portions of left and right longitudinal edges of said elongate core member; and a second left side torsion box member and a second right side torsion box member positioned adjacent longitudinal edges of said first left and right side torsion box members respectively, further comprising a third torsion box which includes said first and second torsion box members therewithin.

3. A snowboard comprising:

an elongate core member;

a first left side torsion box member and a first right side torsion box member, said first side members positioned adjacent at least respective first portions of left and right longitudinal edges of said elongate core member; and a second left side torsion box member and a second right side torsion box member positioned adjacent longitudinal edges of said first left and right side torsion box members respectively, and further comprising third left and right torsion boxes spaced between said elongate core and said first and second torsion box members respectively, spacing means positioned between said third left and right torsion boxes and said first and second torsion box members.

4. A snowboard core comprising:

an elongate core member;

a first pair of side members, one of said first side members positioned adjacent at least a first longitudinal portion of said elongate core member, the other side member positioned adjacent at least a second longitudinal portion of said elongate core member; and a second pair of side members, one of said second side members positioned adjacent at least a longitudinal portion of one of said first side members, the other second side member positioned adjacent said other first side member, wherein said elongate core member is positioned within a seamless tubular fiber sock carrying a binder resin for providing a composite about a circumference of the elongate core member, wherein each of said first pair of side members is positioned within a seamless tubular fiber sock carrying a binder resin for providing a composite about a circumference of the side members.

5. A snowboard core according to claim 4 wherein each of said second pair of side members is positioned within a seamless tubular fiber sock carrying a binder resin for providing a composite about a circumference of the second side members.

6. A snowboard core according to claim 4 wherein each of said first pair of side members, said second pair of side members and their accompanying composite are positioned within a seamless tubular fiber sock carrying a binder resin for providing a composite about a circumference of the first and second side members and their accompanying composites.

7. A snowboard core according to claim 6 wherein the composite about the circumference of the elongate core member also surrounds the first and second side members and their respective composites.

8. A snowboard according to claim 6 further comprising a pair of spacer members, said spacer members being positioned between adjacent pairs of said first and second side members.

* * * * *